US010314347B2

(12) United States Patent
Uozumi et al.

(10) Patent No.: US 10,314,347 B2
(45) Date of Patent: Jun. 11, 2019

(54) HIGH-VISIBILITY FABRIC AND HIGH-VISIBILITY CLOTHING MADE USING THE HIGH-VISIBILITY FABRIC

(71) Applicants: KOMATSU MATERE CO., LTD., Ishikawa (JP); KANEKA CORPORATION, Osaka (JP)

(72) Inventors: Konosuke Uozumi, Ishikawa (JP); Osamu Hanida, Ishikawa (JP); Itsuro Yamazaki, Ishikawa (JP)

(73) Assignees: KOMATSU MATERE CO., LTD., Ishikawa (JP); KANEKA CORPORATION, Osaka (JP)

( * ) Notice: Subject to any disclaimer, the term of this patent is extended or adjusted under 35 U.S.C. 154(b) by 155 days.

(21) Appl. No.: 15/030,988

(22) PCT Filed: Oct. 27, 2014

(86) PCT No.: PCT/JP2014/005430
§ 371 (c)(1),
(2) Date: Apr. 21, 2016

(87) PCT Pub. No.: WO2015/064079
PCT Pub. Date: May 7, 2015

(65) Prior Publication Data

US 2016/0242475 A1 Aug. 25, 2016

(30) Foreign Application Priority Data

Oct. 31, 2013 (JP) ..... 2013-227317
Dec. 6, 2013 (JP) ..... 2013-253526

(51) Int. Cl.
*A41D 13/00* (2006.01)
*A41D 13/01* (2006.01)
(Continued)

(52) U.S. Cl.
CPC ..... *A41D 13/01* (2013.01); *D06N 3/0065* (2013.01); *D06P 1/0012* (2013.01); *D06P 1/44* (2013.01); *D06N 2209/0892* (2013.01)

(58) Field of Classification Search
CPC ..... A41D 13/01; D06P 1/0012; D06P 1/44
See application file for complete search history.

(56) References Cited

U.S. PATENT DOCUMENTS 4,172,063 A 10/1979 O'Brill
5,695,853 A * 12/1997 Billingsley ..... A41D 13/01 2/102
(Continued)

FOREIGN PATENT DOCUMENTS

CN 1990613 7/2007
CN 101560735 10/2009
(Continued)

OTHER PUBLICATIONS

Extended European Search Report dated Jun. 6, 2017 in corresponding European Application No. 14859001.1.
(Continued)

*Primary Examiner* — Cephia D Toomer
(74) *Attorney, Agent, or Firm* — Wenderoth, Lind & Ponack, L.L.P.

(57) ABSTRACT

A high-visibility fabric according to the present invention is a fabric that is colored and includes, on at least one surface, a colored part that is colored by an application of a fluorescent-pigment-containing resin. The fluorescent-pigment-containing resin is applied to at least an entire outer surface of the colored part, and the colored part has a color that meets requirements of "5.1 Color performance requirements of new material" and "5.2 Color after Xenon test" of ISO 20471:2013.

17 Claims, 5 Drawing Sheets

| Evaluation item | | | Example 1 | Comparative example 1 | Comparative example 2 | Example 2 | Comparative example 3 | Comparative example 4 | Example 3 | Comparative example 5 | Comparative example 6 |
|---|---|---|---|---|---|---|---|---|---|---|---|
| A Color | Before application of fluorescent-pigment-containing resin | x coordinate | 0.547 | 0.547 | – | 0.547 | 0.547 | – | 0.513 | 0.513 | – |
| | | y coordinate | 0.384 | 0.384 | – | 0.397 | 0.397 | – | 0.357 | 0.357 | – |
| | | Lumingnce factor Y | 0.58 | 0.58 | – | 0.57 | 0.57 | – | 0.60 | 0.60 | – |
| | After application of fluorescent-pigment-containing resin | x coordinate | 0.562 | – | 0.547 | 0.583 | – | 0.582 | 0.584 | – | 0.585 |
| | | y coordinate | 0.368 | – | 0.370 | 0.360 | – | 0.358 | 0.365 | – | 0.362 |
| | | Lumingnce factor Y | 0.45 | – | 0.44 | 0.43 | – | 0.43 | 0.42 | – | 0.43 |
| B Color after Xenon test | After application of fluorescent-pigment-containing resin | x coordinate | 0.542 | 0.542 | 0.531 | 0.544 | 0.520 | 0.510 | 0.545 | 0.442 | 0.502 |
| | | y coordinate | 0.373 | 0.385 | 0.396 | 0.377 | 0.408 | 0.380 | 0.374 | 0.366 | 0.389 |
| | | Lumingnce factor Y | 0.43 | 0.56 | 0.43 | 0.44 | 0.59 | 0.46 | 0.43 | 0.62 | 0.45 |
| C Air permeability [cm³/cm²·s] | | | 10 or more | – | – | 10 or more | – | – | 10 or more | – | – |
| D Moisture permeability [g/m²·24hrs] | | A–1 | 10100 | – | – | 9800 | – | – | 3800 | – | – |
| | | B–1 | 22300 | – | – | 10100 | – | – | 20500 | – | – |
| E Water pressure resistance [mm] | | | 20000 or more | – | – | 6000 | – | – | 20000 or more | – | – |
| F Surface observation of colored part | | | The fluorescent-pigment-containing resin was attached to the entire surface (fiber surface) of the part applied with the resin on the fiber fabric. Although the resin was attached to some crossing points of the yarns and also covered some spaces between the fibers, most parts were not completely covered with resin and spaces were left between yarns and between fibers. | – | – | The fluorescent-pigment-containing resin was attached to the entire surface (fiber surface) of the part applied with the resin on the fiber fabric. Although the resin was attached to some crossing points of the yarns and also covered some spaces between the fibers, most parts were not completely covered with resin and spaces were left between yarns and between fibers. | – | – | The fluorescent-pigment-containing resin was attached to the entire surface (fiber surface) of the part applied with the resin on the fiber fabric. Although the resin was attached to some crossing points of the yarns and also covered some spaces between the fibers, most parts were not completely covered with resin and spaces were left between yarns and between fibers. | – | – |
| G Height of part applied with resin | | | The height of an area containing particles (assumed to be pigments) with diameters of 1 μm to 2 μm was 1 μm to 2 μm because of these particles. The height of an area where the resin was attached but no particles were seen was less than 1 μm even observed at 4500 times magnification. Thus, an extremely thin resin film was formed. | – | – | The height of an area containing particles (assumed to be pigments) with diameters of 1 μm to 2 μm was 1 μm to 2 μm because of these particles. The height of an area where the resin was attached but no particles were seen was less than 1 μm even observed at 4500 times magnification. Thus, an extremely thin resin film was formed. | – | – | The height of an area containing particles (assumed to be pigments) with diameters of 1 μm to 2 μm was 1 μm to 2 μm because of these particles. The height of an area where the resin was attached but no particles were seen was less than 1 μm even observed at 4500 times magnification. Thus, an extremely thin resin film was formed. | – | – |
| H Texture | | | Still soft even though slightly more hardened than before processing | – | – | Still soft even though slightly more hardened than before processing | – | – | Still soft even though slightly more hardened than before processing | – | – |
| I Flame retardancy | | | Pass | – | – | – | – | – | Pass | – | – |

(51) Int. Cl.

| | |
|---|---|
| ***D06P 1/00*** | (2006.01) |
| ***D06P 1/44*** | (2006.01) |
| ***D06N 3/00*** | (2006.01) |

(56) References Cited

U.S. PATENT DOCUMENTS

| | | | | |
|---|---|---|---|---|
| 6,706,650 | B2 | 3/2004 | Gibson et al. | |
| 6,787,228 | B2 | 9/2004 | Campbell et al. | |
| 6,946,412 | B2 | 9/2005 | Campbell et al. | |
| 7,419,922 | B2 | 9/2008 | Gibson et al. | |
| 8,236,064 | B2 | 8/2012 | Hendel et al. | |
| 2006/0030228 | A1 | 2/2006 | Truesdale, III | |
| 2006/0073756 | A1* | 4/2006 | Kayali ..... | D04H 3/16 442/401 |
| 2008/0057807 | A1 | 3/2008 | Tutterow et al. | |
| 2010/0112312 | A1 | 5/2010 | Tutterow et al. | |
| 2010/0269242 | A1 | 10/2010 | Stubiger | |
| 2011/0183560 | A1 | 7/2011 | Hendel et al. | |
| 2013/0008554 | A1 | 1/2013 | Fisher et al. | |
| 2014/0041107 | A1 | 2/2014 | Rose et al. | |
| 2015/0086758 | A1 | 3/2015 | Tutterow et al. | |

FOREIGN PATENT DOCUMENTS

| | | | |
|---|---|---|---|
| CN | 101718039 | | 6/2010 |
| CN | 102152562 | | 8/2011 |
| CN | 202035512 | | 11/2011 |
| CN | 102433730 | | 5/2012 |
| EP | 2 823 723 | | 1/2015 |
| JP | 3-137272 | | 6/1991 |
| JP | 4-93377 | | 3/1992 |
| JP | 2004-76202 | | 3/2004 |
| JP | 2008-509297 | | 3/2008 |
| JP | 2010-502849 | | 1/2010 |
| JP | 2011-505881 | | 3/2011 |
| JP | 2013-522494 | | 6/2013 |
| JP | 2013-139106 | | 7/2013 |
| WO | 2005/061777 | | 7/2005 |
| WO | WO2005061777 | * | 7/2005 |
| WO | 2006/017709 | | 2/2006 |
| WO | 2008/004810 | | 1/2008 |
| WO | 2008/027454 | | 3/2008 |
| WO | 2009/052936 | | 4/2009 |
| WO | 2011/114108 | | 9/2011 |

OTHER PUBLICATIONS

International Search Report dated Jan. 27, 2015 in corresponding International Application No. PCT/JP2014/005430.

* cited by examiner

FIG. 1

| Evaluation item | | | Example 1 | Comparative example 1 | Comparative example 2 | Example 2 | Comparative example 3 | Comparative example 4 | Example 3 | Comparative example 5 | Comparative example 6 |
|---|---|---|---|---|---|---|---|---|---|---|---|
| A | Color: Before application of fluorescent-pigment-containing resin | X coordinate | 0.547 | 0.547 | — | 0.547 | 0.547 | — | 0.513 | 0.513 | — |
| | | Y coordinate | 0.384 | 0.384 | — | 0.397 | 0.397 | — | 0.357 | 0.357 | — |
| | | Luminance factor β | 0.58 | 0.58 | — | 0.57 | 0.57 | — | 0.60 | 0.60 | — |
| | Color: After application of fluorescent-pigment-containing resin | X coordinate | 0.562 | — | 0.547 | 0.583 | — | 0.582 | 0.584 | — | 0.585 |
| | | Y coordinate | 0.368 | — | 0.370 | 0.360 | — | 0.358 | 0.365 | — | 0.362 |
| | | Luminance factor β | 0.45 | — | 0.44 | 0.43 | — | 0.43 | 0.42 | — | 0.43 |
| B | Color after Xenon test after application of fluorescent-pigment-containing resin | X coordinate | 0.542 | 0.542 | 0.531 | 0.544 | 0.520 | 0.510 | 0.545 | 0.442 | 0.502 |
| | | Y coordinate | 0.373 | 0.385 | 0.396 | 0.377 | 0.408 | 0.380 | 0.374 | 0.366 | 0.389 |
| | | Luminance factor β | 0.43 | 0.56 | 0.43 | 0.44 | 0.59 | 0.46 | 0.43 | 0.62 | 0.45 |
| C | Air permeability [$cm^3/cm^2 \cdot s$] | | 10 or more | — | — | 10 or more | — | — | 10 or more | — | — |
| D | Moisture permeability [$g/m^2 \cdot 24hrs$] | A−1 | 10100 | — | — | 9800 | — | — | 3800 | — | — |
| | | B−1 | 22300 | — | — | 10100 | — | — | 20500 | — | — |
| E | Water pressure resistance [mm] | | 20000 or more | — | — | 6000 | — | — | 20000 or more | — | — |
| F | Surface observation of colored part | | The fluorescent-pigment-containing resin was attached to the entire surface (fiber surface) of the part applied with the resin on the fiber fabric. Although the resin was attached to some crossing points of the yarns and also covered some spaces between the fibers, most parts were not completely covered with resin and spaces were left between yarns and between fibers. | — | — | The fluorescent-pigment-containing resin was attached to the entire surface (fiber surface) of the part applied with the resin on the fiber fabric. Although the resin was attached to some crossing points of the yarns and also covered some spaces between the fibers, most parts were not completely covered with resin and spaces were left between yarns and between fibers. | — | — | The fluorescent-pigment-containing resin was attached to the entire surface (fiber surface) of the part applied with the resin on the fiber fabric. Although the resin was attached to some crossing points of the yarns and also covered some spaces between the fibers, most parts were not completely covered with resin and spaces were left between yarns and between fibers. | — | — |
| G | Height of part applied with resin | | The height of an area containing particles (assumed to be pigments) with diameters of 1 μm to 2 μm was 1 μm to 2 μm because of these particles. The height of an area where the resin was attached but no particles were seen was less than 1 μm even observed at 4500 times magnification. Thus, an extremely thin resin film was formed. | — | — | The height of an area containing particles (assumed to be pigments) with diameters of 1 μm to 2 μm was 1 μm to 2 μm because of these particles. The height of an area where the resin was attached but no particles were seen was less than 1 μm even observed at 4500 times magnification. Thus, an extremely thin resin film was formed. | — | — | The height of an area containing particles (assumed to be pigments) with diameters of 1 μm to 2 μm was 1 μm to 2 μm because of these particles. The height of an area where the resin was attached but no particles were seen was less than 1 μm even observed at 4500 times magnification. Thus, an extremely thin resin film was formed. | — | — |
| H | Texture | | Still soft even though slightly more hardened than before processing | — | — | Still soft even though slightly more hardened than before processing | — | — | Still soft even though slightly more hardened than before processing | — | — |
| I | Flame retardancy | | Pass | — | — | — | — | — | Pass | — | — |

FIG. 2

ISO 20471:2013
5.1 Color performance requirements of new material

| | Chromaticity coordinate | | Lower limit of luminance factor |
|---|---|---|---|
| | X coordinate | Y coordinate | Luminance factor β |
| Fluorescent orange red | 0.610 | 0.390 | 0.40 |
| | 0.535 | 0.375 | |
| | 0.570 | 0.340 | |
| | 0.655 | 0.345 | |

FIG. 3
〔Surface at 30 times magnification〕
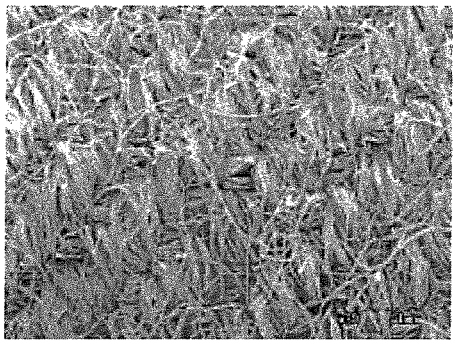
〔Surface at 50 times magnification〕
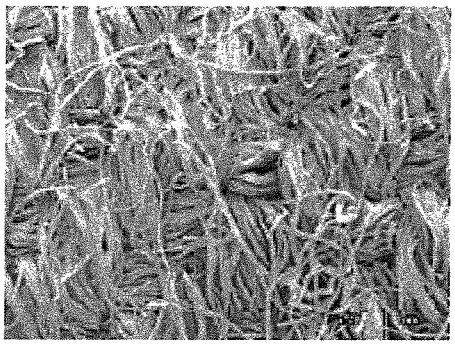
〔Surface at 100 times magnification〕
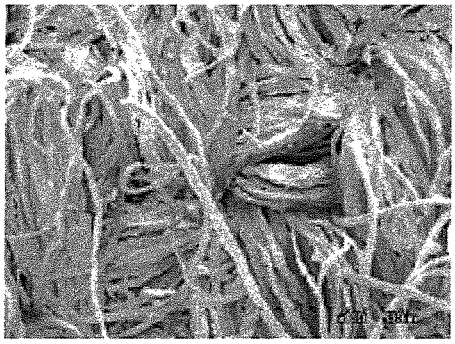
〔Surface at 1500 times magnification〕
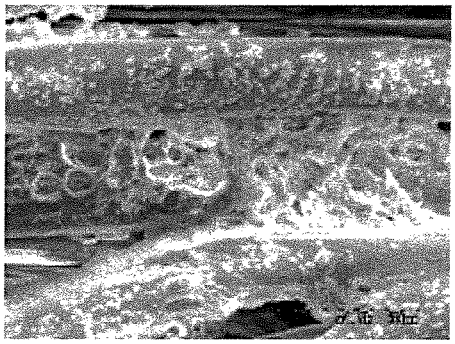
〔Surface at 2000 times magnification〕
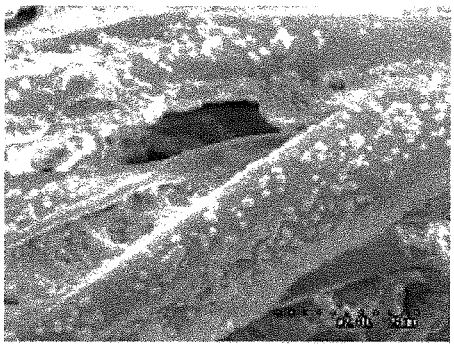

FIG. 4
(Surface of warp at 150 times magnification)
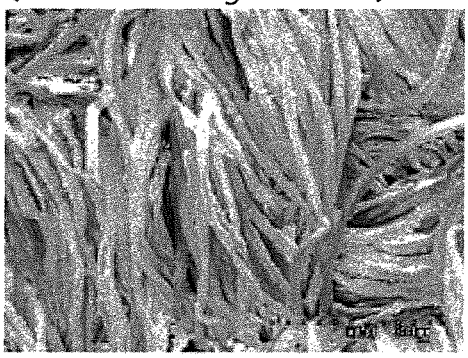
(Surface of weft at 250 times magnification)
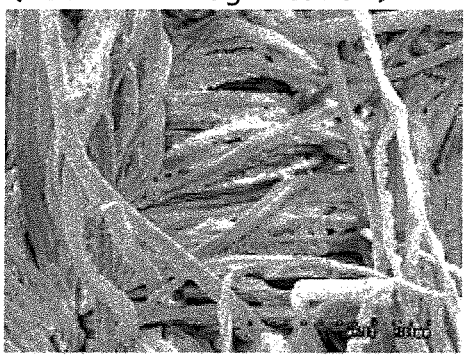
(Surface of crossing point at 1500 times magnification)
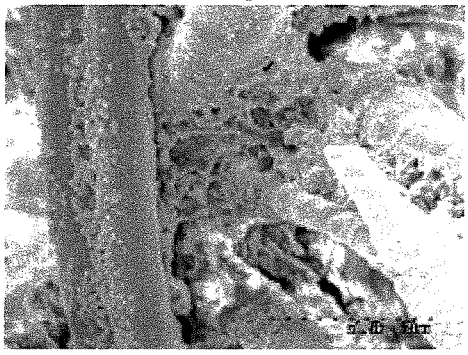

HIGH-VISIBILITY FABRIC AND HIGH-VISIBILITY CLOTHING MADE USING THE HIGH-VISIBILITY FABRIC

TECHNICAL FIELD

The present invention relates to a high-visibility fabric and high-visibility clothing made using the high-visibility fabric.

BACKGROUND ART

It is desirable that clothing such as work clothes and fire-fighting suits has high visibility that makes workers wearing such clothing readily discernible to other workers and thereby increases safety of the workers. Work places of such workers include local streets, automobile roads, harbors, airports, railroad tracks, parking lots, oilfields, gas fields, and industrial complexes.

EN471 is a European standard for high-visibility clothing. As the international standard, "ISO 20471:2013" was published on Mar. 15, 2013.

To meet the requirements of EN471 defining the high visibility standard, various efforts have been made to high-visibility clothing and fabrics used for the high-visibility clothing. For example, use of a yarn that can be dyed to a high-visibility color is known. Examples of the yarn include a polyester yarn, a modacrylic viscose polyester blended yarn, a modacrylic polyester blended yarn, and a viscose polyester blended yarn, and such a yarn is arranged on one surface of a fabric (see Patent Literature (PTL) 1).

Another example is known as a high-visibility fabric that meets the requirements of EN471. To achieve this fabric, a polymeric material containing a fluorescent pigment is printed on a fabric made of colored aramid, viscose, and polyimide fibers, in a manner causing open areas through which the surface of the colored fabric is partially seen (see PTL 2).

CITATION LIST

Patent Literature

[PTL 1] Japanese Unexamined Patent Application Publication No. 2013-522494

[PTL 2] Japanese Unexamined Patent Application Publication No. 2011-505881

SUMMARY OF INVENTION

Technical Problem

However, uses for the high-visibility fabric having the yarn at a specific position thereof are limited because of, for example, the texture and outward appearance of such a fabric. In addition, such a fabric has been in need of improvement to be comfortable and fashionable. Moreover, while undyed fabrics need to be in stock to be used solely for high-visibility fabrics, uses of these fabrics for different purposes are difficult. To reduce overstock, improvements have been needed to make high-visibility fabrics from any fabrics.

For the high-visibility fabric having the polymeric material printed in a manner causing the open areas through which the surface of the colored fabric is partially seen, the size of an open area needs to be from 1 $mm^2$ to 9 $mm^2$. However, it is difficult to control the size of the open areas with stability for different kinds of fabrics or patterned fabrics. In the case of a patterned fabric, the height of a patterned part is as high as 20 μm to 870 μm (that is, a resin layer becomes thicker). The pattern printed using such a thick resin may add hard texture and also reduce the air permeability and moisture permeability of a resulting fabric. On this account, the open areas need to be provided. Thus, it is difficult to produce fabrics that have stable texture, air permeability, and moisture permeability while meeting the requirements of EN471.

Moreover, whether the high-visibility fabrics manufactured using the aforementioned techniques meet the requirements of "5.1 Colour performance requirements of new material" and "5.2 Colour after Xenon test" of ISO 20471:2013 is not described.

Therefore, the present invention aims to provide a high-visibility fabric that is not limited to a specific weave while being superior in production stability, and that includes a colored part meeting the requirements of "5.1 Colour performance requirements of new material" and "5.2 Colour after Xenon test" of ISO 20471:2013.

Solution to Problem

As a result of keen examination to solve the aforementioned problems, the inventors have achieved the present invention.

To be more specific, to solve the aforementioned problems, a high-visibility fabric according to an aspect of the present invention is a fabric that is colored and includes, on at least one surface, a colored part that is colored by an application of a fluorescent-pigment-containing resin, the fluorescent-pigment-containing resin being applied to at least an entire outer surface of the colored part, and the colored part having a color that meets requirements of "5.1 Colour performance requirements of new material" and "5.2 Colour after Xenon test" of ISO 20471:2013.

According to the high-visibility fabric according to the present invention, the colored part has a height of less than 20 μm.

According to the high-visibility fabric according to the present invention, the fabric has a waterproof resin film on one surface.

According to the high-visibility fabric according to the present invention, the fluorescent-pigment-containing resin contains flame retardant chemicals.

Moreover, clothing according to an aspect of the present invention is at least partially made using the high-visibility fabric according to any one of aspects of the present invention.

Advantageous Effects of Invention

The high-visibility fabric according to the present invention has excellent high visibility and can also reduce limitations on fabrics available to make the high-visibility fabric. The reduction in limitation increases options in texture and appearance of the high-visibility fabric. Moreover, the high-visibility fabric superior in lightfastness can be provided.

BRIEF DESCRIPTION OF DRAWINGS

FIG. 1 is a diagram showing performance for each of fabrics obtained in Examples 1 to 3 and Comparative examples 1 to 6 according to the present invention.

FIG. 2 is a diagram showing requirements for orange-red in "5.1 Colour performance requirements of new material" of ISO 20471:2013.

FIG. 3 is a diagram showing electron microscope photographs of a surface of a high-visibility fabric in Example according to the present invention.

FIG. 4 is a diagram showing electron microscope photographs of a surface of a high-visibility fabric in Example according to the present invention.

DESCRIPTION OF EMBODIMENT

Figure 5:
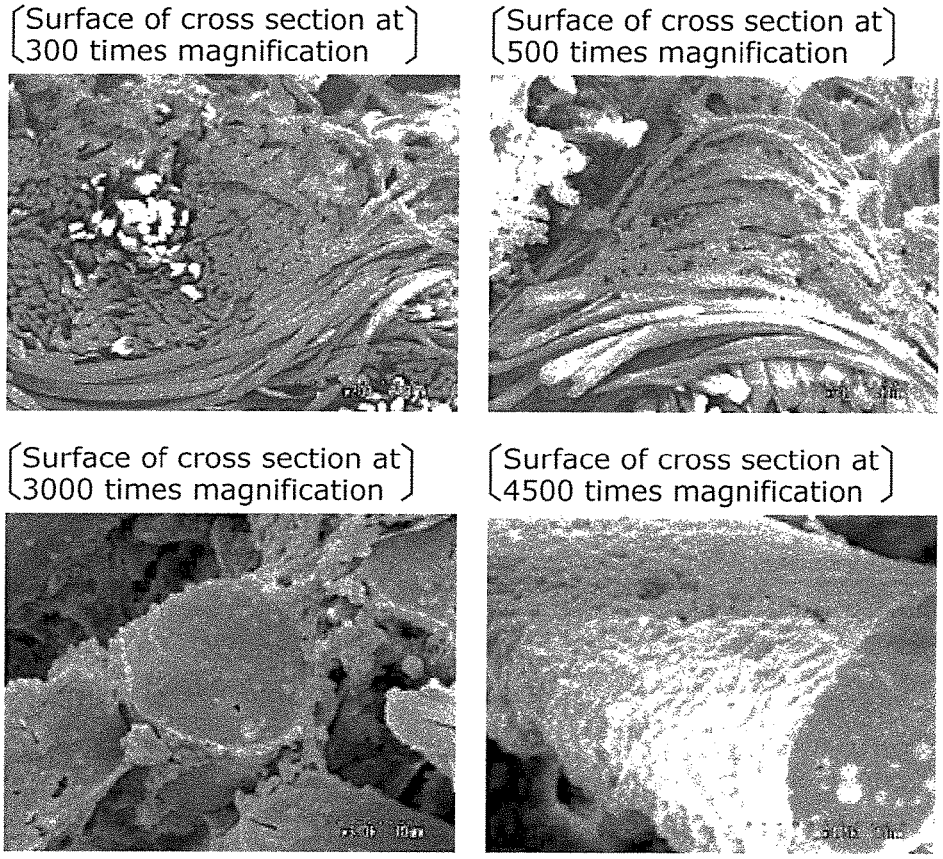
FIG. 5 is a diagram showing electron microscope photographs of cross sections of a high-visibility fabric in Example according to the present invention.

The following is a description of preferred embodiments according to the present invention. It should be noted that the present invention is not limited to these embodiments. Various changes and modifications are possible within the spirit and scope of the present invention.

[High-Visibility Fabric]

A high-visibility fabric in Embodiment according to the present invention is a fabric that is colored and includes, on at least one surface, a colored part that is colored by an application of a fluorescent-pigment-containing resin, the fluorescent-pigment-containing resin being applied to at least an entire outer surface of the colored part, and the colored part having a color that meets requirements of "5.1 Colour performance requirements of new material" and "5.2 Colour after Xenon test" of ISO 20471:2013.

Examples of materials for fabrics useful in Embodiment may include the following: chemical fibers, such as polyester, nylon, aramid, acrylic, modacrylic, polyurethane, acetate, rayon like viscose, polylactate, polyimide, polyphenylene sulfide, and fluorine; and natural fibers, such as cotton, linen, silk, and wool. These materials may be combined, blended, mixed, or interknitted. Note that the materials are not particularly limited to these. Moreover, a fabric made of these materials may be in any form, such as a woven fabric, a knitted fabric, or an unwoven fabric.

During the fiber spinning process of the fibers and fabric, chemicals such as flame retardant (flameproofing agent) may be added to a spinning resin. Moreover, as postprocessing after a yarn or a fabric is made, processes may be performed, such as flame retardant treatment (flame proofing), antistatic finishing, water repellent finishing, antimicrobial and deodorant finishing, antibacterial finishing, ultraviolet screening, and lightfastness enhancing treatment.

Furthermore, the fabric is previously colored. A resin containing a fluorescent pigment is applied to further color the previously colored fabric, and the resulting fabric thus improves in performance in xenon lightfastness testing (i.e., improves in lightfastness).

The aforementioned previous coloring may be performed on the yarn or fabric using a dye. Alternatively, at the time of fiber spinning, the fibers may be colored with a spinning resin kneaded with a pigment. In terms of quick delivery, it is preferable that coloring is performed on the yarn or fabric, particularly on the fabric, using a dye.

Examples of the dye include a disperse dye, a cationic dye, an acid dye, a direct dye, a reactive dye, a vat dye, a sulfur dye, and a fluorescent whitening dye. However, the dye to be used here is not particularly limited to these, and therefore a dye suitable for the material of the fabric may be selected as appropriate. It is preferable that the dye containing fluorescence is used. With this, the resulting high-visibility fabric is easily adjusted to a color that meets the requirements of "5.1 Colour performance requirements of new material" and "5.2 Colour after Xenon test" of ISO 20471:2013.

Moreover, as a fluorescent pigment used in Embodiment, any fluorescent pigment suitable for a desired color may be used. Examples of the fluorescent pigment include, but not particularly limited to, yellow, orange, red, pink, blue, and white.

The resin containing the fluorescent pigment (also referred to as the "fluorescent-pigment-containing resin" hereafter) may contain a different pigment containing no florescence. Thus, any kind of pigment combination can be made to meet the requirements of "5.1 Colour performance requirements of new material" and "5.2 Colour after Xenon test" of ISO 20471:2013. The high-visibility fabric in Embodiment meet all the requirements for fluorescent yellow, fluorescent orange-red, and fluorescent red in the aforementioned sections of the ISO standard.

It should be noted that, in Embodiment, a composite color of the colored fabric and the fluorescent-pigment-containing resin applied to the colored fabric meets the requirements of "5.1 Colour performance requirements of new material" and "5.2 Colour after Xenon test" of ISO 20471:2013.

Thus, the fluorescent-pigment-containing resin does not completely cover the color of the previously colored fabric. To be more specific, the color of the previously colored fabric still has an effect as the surface color of the high-visibility fabric even at an area where the fluorescent-pigment-containing resin is attached. This means that the fluorescent-pigment-containing resin has transparency. Particularly for fluorescent orange-red, when either the color of the fabric or the color of the resin meets the requirements of "5.1 Colour performance requirements of new material" of ISO 20471:2013, it is difficult to obtain a color that meets the requirements of "5.2 Colour after Xenon test" of ISO 20471:2013.

Any resin may be used as the resin containing the fluorescent pigment (the fluorescent-pigment-containing resin). Examples include a urethane resin, an acrylic resin, a silicon resin, a polyester resin, and a nylon resin.

In addition to the pigment such as a fluorescent pigment, the resin may also contain an ultraviolet absorber, an antioxidant, a crosslinker, a catalyst, a deodorant, an antimicrobial agent, a flame retardant, a water repellent, or an infrared absorber.

In particular, as the fluorescent-pigment-containing resin to be applied to the fabric, a liquid resin containing the fluorescent pigment is used. In view of durability to withstand washing and wear and tear, this liquid resin may preferably contain a crosslinker. Specific examples of the crosslinker include a melamine-based crosslinker, an isocyanate-based crosslinker, an imine-based crosslinker, an epoxide-based crosslinker, an oxazoline-based crosslinker, and a carbodiimide-based crosslinker.

Moreover, in view of flame retardancy, it is desirable that the fluorescent-pigment-containing resin contains a flame proofing agent. Specific examples of the flame proofing agent include the following: halogen-based flame retardants, such as antimony trioxide, hexabromocyclododecane, and tris (2,3-dibromopropyl) isocyanurate; and phosphorus-based flame retardants, such as naphthyl diphenyl phosphate and phosphate ester amide like biphenylyl diphenyl phosphate or diphenyl (phenyl amide) phosphate.

Depending on the intended flame retardancy standard, a fabric made of fibers having flame retardancy in themselves, such as flame retardant polyester, aramid resin, modacrylic resin, or polyimide resin, can meet the flame retardancy standard without containing a flameproofing agent in the fluorescent-pigment-containing resin (liquid resin).

In Embodiment, a fabric is colored and includes, on at least one surface, a colored part that is colored by an application of a fluorescent-pigment-containing resin, the fluorescent-pigment-containing resin being applied to at least an entire outer surface of the colored part of the fabric.

The outer surface of the part colored by the application of the fluorescent-pigment-containing resin on the fabric is completely covered with the fluorescent-pigment-containing resin. Thus, the color of this part meets the requirements of "5.2 Colour after Xenon test" of ISO 20471:2013.

In Embodiment, the outer surface of the part colored by the application of the fluorescent-pigment-containing resin on the fabric is completely covered with the fluorescent-pigment-containing resin. This means that the outer surface of the thus colored part as a result of the application of the fluorescent-pigment-containing resin on the fabric is entirely covered with the resin, and that the surface of the part applied with the fluorescent-pigment-containing resin on the fabric has no open areas substantially from 1 $mm^2$ to 9 $mm^2$. That is, the fluorescent-pigment-containing resin is attached to the entire outer surfaces of the fibers making up the outer surface of the part applied with the resin the fabric. However, even on the outer surface of the part applied with the fluorescent-pigment-containing resin on the fabric, the resin may or may not cover the following: the undersurfaces of the fibers; a space between the yarns, a crossing point of the yarns, or an interfiber space between the fibers making up the yarn. Moreover, even on the outer surface of the part applied with the fluorescent-pigment-containing resin on the fabric, areas with the size smaller than 1 $mm^2$ where the resin is not attached may be scattered. To achieve the object of the present invention, it is only required that the resin is substantially attached to the entire surface of the part colored by the application of fluorescent-pigment-containing resin on the fabric.

Thus, as long as the fluorescent-pigment-containing resin is substantially attached to the entire surface of the part colored by application of fluorescent-pigment-containing resin on the fabric, the entire surface of the fabric may be colored by the application of the fluorescent-pigment-containing resin. Alternatively, the fluorescent-pigment-containing resin may be applied partially to the fabric to make a freely-selected pattern, such as a plaid pattern, a stripe pattern, a geometric pattern, or a plant pattern. In view of visibility, it is preferable that the pattern is large and that parts applied with the fluorescent-pigment-containing resin on the fabric to make the pattern have a width of 50 mm or more.

Moreover, the height of the part applied with the resin (i.e., the thickness of the pigment-containing resin layer) on the fabric may be preferably less than 20 μm, more preferably 10 μm or less, or even more preferably 2 μm or less. The resin-applied part having the height less than 20 μm makes it easier to leave spaces between the yarns making up the fabric and between the fibers making up the yarns. Such spaces allow the texture of the fabric to be soft and suppress a reduction in the air permeability of the fabric. The spaces also suppress a reduction in the moisture permeability of the fabric when a moisture-permeable waterproof film described later is laminated on the fabric. The lower limit of the height of the resin-applied part is, but not particularly limited to, about 0.1 μm in view of the fixing property and durability of the fluorescent pigment to be applied.

Here, the height of the resin-applied part refers to the height including the pigment and other additives contained in the resin. Thus, depending on the shape of the pigment, such as a spherical shape, a scale-like shape, or a rod-like shape, it is preferable to use the pigment and other additives having a particle diameter of less than 20 μm.

The height of the resin-applied part can be measured using an electron microscope. For example, the height of the resin applied to the surfaces of the fibers making up the fabric is measured using the electron microscope. Here, note that the resin attached to areas between the fibers or between the yarns is exempted from this height measurement.

As described thus far, the high-visibility fabric in Embodiment has excellent high visibility and can also reduce limitations on fabrics available to make the high-visibility fabric since various kinds of fabrics can be used. This increases options in texture and appearance of the high-visibility fabric.

In addition, the part colored by the application of the fluorescent-pigment-containing resin has a color that meets the requirements of "5.2 Colour after Xenon test" of ISO 20471:2013. Thus, the high-visibility fabric superior in lightfastness can be achieved.

Moreover, a waterproof resin film (a waterproof film) may be laminated on one surface of the high-visibility fabric in Embodiment. For example, when the fluorescent-pigment-containing resin is applied to only one surface of the fabric, the waterproof resin film may be laminated on the other surface where the fluorescent-pigment-containing resin is not applied. Thus, the high-visibility fabric superior in waterproof property can be achieved.

Furthermore, it is more preferable that this waterproof resin film has moisture permeability. With this, the high-visibility fabric superior in waterproof property and moisture permeability can be achieved.

Moreover, a different fabric may be laminated on the surface of the waterproof film opposite to the other surface where the high-visibility fabric is laminated. To be more specific, the waterproof film may be sandwiched between the fabrics. This additional different fabric has a function as a lining, for example.

The waterproof resin film (the waterproof film) described in Embodiment refers to a waterproof film that can achieve water pressure resistance of 1000 mm or more when laminated on the fabric. The water pressure resistance of the high-visibility fabric on which the waterproof film is laminated is preferably 5000 mm or more, or more preferably 10000 mm or more. Even more preferably, the water pressure resistance of the high-visibility fabric on which the waterproof film is laminated is 20000 mm or more. This water pressure resistance is measured according to Method A (Low hydraulic pressure method) or Method B (High hydraulic pressure method) of JIS L1092-1988 "Testing methods for water resistance of textiles (Hydrostatic pressure method)." To allow easier comparison between Methods A and B, the measurement unit of the value obtained according to Method B is converted into the unit of mm. When a test specimen is stretched under hydraulic pressure, a nylon taffeta fabric (having a total of about 210 yarns of density of warp and weft per 2.54 cm) is overlaid on the test specimen, which is then set to a testing apparatus for measurement.

Moreover, according to the calcium chloride method (Method A-1 of JIS L1099-1993), the moisture permeability of the high-visibility fabric on which the waterproof film is laminated is preferably 2000 $g/m^2 \cdot 24$ hours or more, more preferably 5000 $g/m^2 \cdot 24$ hours or more, or even more preferably 10000 $g/m^2 \cdot 24$ hours or more.

Furthermore, according to the potassium acetate method (Method B-1 of JIS L1099-1993), the moisture permeability of the high-visibility fabric on which the waterproof film is laminated is also preferably 2000 g/m$^2$·24 hours or more, more preferably 5000 g m$^2$·24 hours or more, or even more preferably 10000 g/m$^2$·24 hours or more.

The moisture permeability according to the calcium chloride or potassium acetate method is expressed in terms of the moisture permeability amount per 24 hours.

Examples of materials used for the waterproof resin film include a urethane resin, a silicon resin, a polyester resin, an acrylic resin, a nylon resin, a vinyl chloride resin, and a polytetrafluoroethylene (PTFE) resin.

To achieve both the waterproof property and the moisture permeability, it is preferable to use a urethane resin, a polyester resin, or PTFE as the material for the resin film.

Moreover, the waterproof resin film may be either porous or non-porous. However, when a PTFE film is used, it is preferable to use a porous film in view of the moisture permeability.

Furthermore, the waterproof resin film may be either a monolayer film having a single layer or a multilayer film having multiple laminated layers. For the multiple laminated layers, different kinds of resins may be used, like a film having a urethane resin layer and a PTFE layer. Alternatively, the same kind of resin may be laminated, like a film having two urethane resin layers.

[Method for Manufacturing High-Visibility Fabric]

The following describes a method for manufacturing a high-visibility fabric in Embodiment. It should be noted that the method for manufacturing the high-visibility fabric in Embodiment is not limited to the method described below. Note also that when a component is already explained above, the same explanation may not be fully repeated in the following.

Firstly, yarns, hanks, or a fabric is prepared and then colored previously to obtain a colored fabric. Coloring may be performed using a cheese dyeing machine, a hank dyeing machine, a winch dyeing machine, a jet dyeing machine, a beam dyeing machine, a jigger dyeing machine, a continuous dyeing machine, a screen printing machine, or an ink jet printer. Moreover, coloring is performed in accordance with conditions including dyes and temperatures corresponding to the material making up the fabric. When coloring is performed on yarns or hanks, the colored yarns or hanks are made into a fabric, which is then used as the colored fabric.

For example, when a blended yarn of polyester fibers and cotton is used, the jet dyeing machine may be used to dye this blended yarn with disperse and reactive dyes at a temperature from 60° C. to 135° C. Here, either the polyester fibers or the cotton may be dyed.

Moreover, at the time of fiber spinning, the fibers may be colored with, for example, a spinning resin containing a pigment. Aramid fibers in particular are frequently colored with a pigment previously at the time of fiber spinning. Thus, these colored fibers may be used for a fabric, or further colored with a cationic dye. Even aramid fibers may be colored with a dye as described above without the pigment-containing spinning resin at the time of fiber spinning. In this case, moisture management and a fluidization process may be performed on the aramid fibers, for example.

Furthermore, modacrylic fibers may be dyed with a cationic dye using, for example, the jet dyeing machine.

A color obtained in coloring may meet the requirements of "5.1 Colour performance requirements of new material" of ISO 20471:2013. However, the color at this time is to be influenced by a color obtained from the application of the fluorescent-pigment-containing resin in a later process. Thus, the color at this time does not necessarily need to meet the requirements of "5.1 Colour performance requirements of new material" of ISO 20471:2013.

As to the color of the colored fabric before the application of the fluorescent-pigment-containing resin, the following are examples: both the chromaticity coordinates and the luminance factor meet the requirements of "5.1 Colour performance requirements of new material" of ISO 20471:2013; both the chromaticity coordinates and the luminance factor do not meet the requirements of "5.1 Colour performance requirements of new material" of ISO 20471:2013; the chromaticity coordinates meet the requirements of "5.1 Colour performance requirements of new material" of ISO 20471:2013 while the luminance factor does not; or the chromaticity coordinates do not meet the requirements of "5.1 Colour performance requirements of new material" of ISO 20471:2013 while the luminance factor does.

It is preferable that the luminance factor of the colored fabric before the application of the fluorescent-pigment-containing resin meets the requirements of "5.1 Colour performance requirements of new material" of ISO 20471:2013. It is more preferable that the luminance factor exceeds the lower limit of the luminance factor specified in "5.1 Colour performance requirements of new material" of ISO 20471:2013 by 0.05 or more, more preferably 0.10 or more, or even more preferably 0.15 or more.

In view of improving the lightfastness, it is preferable that the luminance factor of the colored fabric before the application of the fluorescent-pigment-containing resin is higher than the luminance factor of the part colored later by the application of the fluorescent-pigment-containing resin.

Even when the color is fluorescent orange-red or fluorescent red for which it is difficult to meet the luminance factor requirements, the higher luminance factor of the colored fabric before the application of the fluorescent-pigment-containing resin makes it easier to obtain the high-visibility fabric that meets the requirements of "5.1 Colour performance requirements of new material" and "5.2 Colour after Xenon test" of ISO 20471:2013.

After coloring, soaping or heat setting may be performed as appropriate. Moreover, in parallel with or after this coloring, a process such as flame retardant treatment, antistatic finishing, antimicrobial and deodorant finishing, antibacterial finishing, ultraviolet screening, or lightfastness enhancing treatment may be performed according to, for example, a padding method.

Next, the fluorescent-pigment-containing resin is applied to at least one surface of the colored fabric. This resin application to the fabric may be performed using a flat screen printing machine, a rotary screen printing machine, an ink jet printer, a knife coater, a kiss coater, a gravure coater, or a padder.

The fluorescent-pigment-containing resin may be applied thinly (to be less than 20 μm thick after drying) without leaving any uncovered spots on the surface of the fabric. From this perspective, it is preferable that the resin is applied to the fabric using the flat screen printing machine or the rotary screen printing machine.

Assume that the flat screen printing machine, the rotary screen printing machine, the ink jet printer, or the gravure coater is used for example. In this case, a pattern of uncovered spots (where the resin fails to attach) can be unfortunately caused in a grid pattern or a dot pattern on the surface of the part applied with the fluorescent-pigment-containing resin on the fabric. This pattern can be caused by the gauze screen or the gravure engraving, and correspond to the open areas with the size from 1 $mm^2$ to 9 $mm^2$. On this account, it is preferable that the fluorescent-pigment-containing resin applied to the fabric bleeds on the fibers of the fabric to substantially cover the fiber surfaces.

When the open areas with the size from 1 $mm^2$ to 9 $mm^2$ are caused to the part applied with the fluorescent-pigment-containing resin on the surface of the fabric, it is difficult to meet the requirements of "5.1 Colour performance requirements of new material" and "5.2 Colour after Xenon test" of ISO 20471:2013. On top of this, pockmarks may be possibly caused to reduce the appearance quality.

The liquid resin used for the fluorescent-pigment-containing resin may contain, in addition to the fluorescent pigment and resin, an ultraviolet absorber, an antioxidant, a crosslinker, a catalyst, a deodorant, an antimicrobial agent, a flame retardant, a water repellent, or an infrared absorber as appropriate.

Particularly in view of durability of the colored part to withstand washing and wear and tear, the liquid resin containing the fluorescent pigment may preferably contain a crosslinker. Specific examples of the crosslinker include a melamine-based crosslinker, an isocyanate-based crosslinker, an imine-based crosslinker, an epoxide-based crosslinker, an oxazoline-based crosslinker, and a carbodiimide-based crosslinker.

Moreover, in view of flame retardancy, it is desirable that the fluorescent-pigment-containing resin contains a flame proofing agent. Specific examples of the flame proofing agent include the following: halogen-based flame retardants, such as antimony trioxide, hexabromocyclododecane, and tris (2,3-dibromopropyl) isocyanurate; and phosphorus-based flame retardants, such as naphthyl diphenyl phosphate and phosphate ester amide like biphenylyl diphenyl phosphate or diphenyl (phenyl amide) phosphate.

Depending on the intended flame retardancy standard, a fabric made of fibers having flame retardancy in themselves, such as flame retardant polyester, aramid resin, modacrylic resin, or polyimide resin, can meet the flame retardancy standard without containing a flameproofing agent in the fluorescent-pigment-containing resin (liquid resin).

Moreover, the liquid resin used for the fluorescent-pigment-containing resin may be any of the following: a water solution, a dispersion liquid, an emulsion, and an organic solvent solution.

Then, after the fluorescent-pigment-containing liquid resin is applied to one surface of the fabric, the liquid resin is dried. Note that soaping or heat setting may be performed as appropriate.

Moreover, after the fabric is colored by the application of the fluorescent-pigment-containing liquid resin, a process such as flame retardant treatment, antistatic finishing, antimicrobial and deodorant finishing, antibacterial finishing, ultraviolet screening, lightfastness enhancing treatment, or water repellent finishing may be performed according to, for example, a padding method.

Furthermore, the waterproof resin film (the waterproof film) may be laminated, after the application of the fluorescent-pigment-containing resin, on the fabric surface where the fluorescent-pigment-containing resin is not applied. The following methods are examples of laminating the waterproof film on the fabric.

As one example, the waterproof film is laminated on the fabric as follows. A pipe coater or the like is used to apply a coating of the liquid resin for forming the waterproof resin film to the fabric surface where the fluorescent-pigment-containing resin is not applied. Then, the fabric applied with the liquid resin is immersed in water, for example, which solidifies the resin and removes solvent from the resin. After this, the fabric is dried.

As another example, the waterproof film is laminated on the fabric as follows. A pipe coater or the like is used to apply a coating of the liquid resin to the fabric surface where the fluorescent-pigment-containing resin is not applied. Then, the coating of the liquid resin is dried to form the waterproof resin film.

As another example, the waterproof film is laminated on the fabric as follows. An adhesive is applied to the surface of a previously-formed resin film. Then, this resin film with the adhesive is overlaid on the fabric surface where the fluorescent-pigment-containing resin is not applied. Thus, the fabric and the resin film (the waterproof film) are stuck together with the adhesive. Here, the fabric may be stuck only to the resin film or to the waterproof film formed on, for example, a piece of release paper. Assume that the fabric is to be stuck to the waterproof film laminated on, for example, a piece of release paper. In this case, the waterproof film and the fabric are firstly stuck together, and then the piece of release paper or the like that is unnecessary is peeled off and removed.

As with the fluorescent-pigment-containing liquid resin, the liquid resin used for forming the waterproof film may contain an ultraviolet absorber, an antioxidant, a crosslinker, a catalyst, a deodorant, an antimicrobial agent, a flame retardant, a water repellent, or an infrared absorber.

Moreover, for sticking the waterproof film to the fabric with an adhesive, the adhesive may also contain an ultraviolet absorber, an antioxidant, a crosslinker, a catalyst, a deodorant, an antimicrobial agent, a flame retardant, a water repellent, or an infrared absorber.

After the waterproof film is laminated on the fabric, drying or heat setting may be performed for example.

Moreover, a different woven or knitted fabric may be further stuck with, for example, an adhesive to the waterproof film surface where the fabric is not laminated.

Furthermore, a process such as flame retardant treatment, antistatic finishing, antimicrobial and deodorant finishing, antibacterial finishing, ultraviolet screening, lightfastness enhancing treatment, or water repellent finishing may be performed on the fabric having the waterproof film, according to a padding method for example.

When the fluorescent-pigment-containing resin is applied to both surfaces of the fabric, the waterproof resin film (the waterproof film) may be laminated on either one of the surfaces of the fabric.

The high-visibility fabric manufactured in Embodiment can be used for clothing for example. In particular, the surface colored by the application of the fluorescent-pigment-containing resin may be used for the front side of clothing. With this, the high-visibility clothing can be achieved. In this way, the high-visibility clothing according to Embodiment is at least partially made using the high-visibility fabric described above.

The clothing includes, but not particularly limited to, common jumpers, jackets, down wears, vests, parkas, anoraks, coats, raincoats, shirts, sportswear, gloves, headwear, and footwear. Moreover, the clothing further includes work clothes and fire-fighting suits worn by workers at, for example, local streets, automobile roads, harbors, airports, railway tracks, parking lots, oilfields, gas fields, and industrial complexes.

The high-visibility fabric may be used for a piece of clothing in whole or in part. When used for a part of the piece of clothing, the high-visibility fabric may be used to allow the clothing to have a pattern such as stripe pattern or may be used for the whole of a part of the clothing, such as sleeves, body, or hem. It is preferable that the high-visibility fabric in Embodiment is used for the entire outer surface of the piece of clothing.

When the high-visibility fabric is used for making a stripe pattern, the width of a stripe is not limited to a particular value. However, in view of high visibility, it is preferable that the width is 50 mm or more. Moreover, it is preferable that the high-visibility fabric extends over the front and back of the clothing when the clothing is worn. For example, the high-visibility fabric may be used continuously from the front to the back of the clothing.

It is preferable that the size of the high-visibility fabric to be used for the outer surface of a piece of clothing is 0.14 $m^2$ or more, more preferably 0.5 $m^2$ or more, or even more preferably 0.8 $m^2$ or more. It is more preferable that the high-visibility fabric is used for the entire piece of clothing.

It should be noted that the high-visibility fabric in Embodiment can be used not only for clothing, but also for tents, bibs, and banners for example.

EXAMPLES

Although the following further describes the high-visibility fabric in Embodiment according to Examples, the present invention is not limited to Examples described below. In Examples and Comparative examples described below, measurements and evaluations of various physical properties in evaluation items A to H were made according to the following methods.

[A Determination of Conformance to "5.1 Colour Performance Requirements of New Material" of ISO 20471:2013]

Pursuant to the section 5.1 of ISO 20471:2013, Y, x, and y of a Yxy color system were measured and determined using a spectrophotometer (CM-2500C [manufactured by Konica Minolta, Inc.]). A luminance factor β was calculated by β=Y/100. For the fabric having a part colored by the application of the fluorescent-pigment-containing resin on one surface of the fabric, the surface applied with the fluorescent-pigment-containing resin was measured.

[B Determination of Conformance to "5.2 Colour after Xenon Test" of ISO 20471:2013]

Pursuant to the section 5.2 of ISO 20471:2013, Y, x, and y of a Yxy color system were measured and determined using a spectrophotometer (CM-2500C [manufactured by Konica Minolta, Inc.]). A luminance factor β was calculated by β=Y/100. For the fabric having a part colored by the application of the fluorescent-pigment-containing resin on one surface of the fabric, the surface applied with the fluorescent-pigment-containing resin was measured.

[C Air Permeability]

The air permeability of the fabric obtained after the application of the fluorescent-pigment-containing resin but before the lamination of the waterproof film was measured in conformance with Method A (Frazier method) of JIS L1096:2010.

[D Moisture Permeability]

The moisture permeability according to the calcium chloride method was measured in conformance with Method A-1 of JIS L1099-1993. The moisture permeability according to the potassium acetate method was measured in conformance with Method B-1 of JIS L1099-1993.

The moisture permeability according to the calcium chloride or potassium acetate method is expressed in terms of the moisture permeability amount per 24 hours.

[E Water Pressure Resistance]

The water pressure resistance was measured in conformance with Method A (Low hydraulic pressure method) and Method B (High hydraulic pressure method) of ITS L1092:1988 "Testing methods for water resistance of textiles (Hydrostatic pressure method)." To allow easier comparison between Methods A and B, the measurement unit of the value obtained using Method B was converted into the unit of mm.

When a test specimen is stretched under hydraulic pressure, a nylon taffeta fabric (having a total of about 210 yarns of density of warp and weft per 2.54 cm) is overlaid on the test specimen, which was then set to a testing apparatus for measurement.

[F Observation of Surface of Part Colored with Fluorescent-Pigment-Containing Resin, and Height of the Part Applied with Resin]

The surface of the part colored with the fluorescent-pigment-containing resin was observed at 30 to 4500 times magnification using a scanning electron microscope (SEM-EDX type H [manufactured by Hitachi Science Systems, Ltd.]). Moreover, the height of the part colored with the fluorescent-pigment-containing resin was measured.

[G Texture]

The texture was determined by touching by hand.

[H Flame Retardancy]

The flame retardancy was determined as "Pass" or "Fail" by a test pursuant to Procedure A (surface ignition) of ISO 15025:2000.

Example 1

A plain weave fabric made of para-aramid filament fibers manufactured by DU PONT-TORAY CO., LTD. (Product name: KEVLAR Type 956, with 1670 decitex (dtex) and 1000 filaments) was dyed at 130° C. for 60 minutes. The dyes were Aizen Cathilon Orange RH (a cationic dye manufactured by HODOGAYA CHEMICAL CO., LTD.) and MIKA white ATN (a fluorescent whitening agent manufactured by Nippon Kayaku Co., Ltd.). Then, the fabric was processed at 90° C. for 10 minutes using a water solution containing 2 grams (g) of soda ash per litter and 2 g of hydrosulfite per litter. After this, the fabric was rinsed in water and dried at 120° C. for 30 seconds. Then, after heat setting performed at 200° C. for one minute, an orange-colored fabric was obtained.

Next, the following fluorescent-pigment-containing liquid resin was applied to one entire surface of the orange-colored fabric using a rotary screen printing machine. After being dried at 90° C. for one minute, this fabric underwent heat treatment at 160° C. for 30 seconds.

[Fluorescent-Pigment-Containing Liquid Resin]

| | |
|---|---|
| DK binder FV-10C (emulsion liquid containing phosphate ester amide, urethane resin, mineral spirits, and water, and manufactured by DAIKYO CHEMICAL CO., LTD.) | 75% by mass |
| RYUDYE-W Lumius Orange NF (fluorescent pigment manufactured by DIC Corporation) | 20% by mass |
| RYUDYE-W Orange RS-E (pigment manufactured by DIC Corporation) | 1% by mass |
| RYUDYE-W Yellow NLA275 (pigment manufactured by DIC Corporation) | 2% by mass |
| Crosslinker (isocyanate-based crosslinker with a solid content of 100%) | 2% by mass |

Next, a porous PTFE film (TX2201 manufactured by NIPPON DONALDSON, LTD.) was applied as a waterproof resin film to the fabric obtained as described thus far.

To be more specific, the following adhesive liquid resin was applied in a dotted manner to the PTFE film, which was then stuck to the fabric surface where the fluorescent-pigment-containing resin was not applied. After this, drying was performed at 120° C.

[Adhesive Liquid Resin]

| | |
|---|---|
| Two-component polyurethane resin | 100 parts by mass |
| Flame retardant (diethylphosphinic acid aluminum salt) | 50 parts by mass |
| Toluene | 30 parts by mass |
| Methyl ethyl ketone (MEK) | 40 parts by mass |
| Isocyanate (Coronate-HL manufactured by Nippon Polyurethane Industry Co., Ltd.) | 9 parts by mass |
| Amine catalyst (HI-299 manufactured by Dainichiseika Color & Chemicals Mfg. Co., Ltd.) | 0.5 parts by mass |

Next, 5% solution of a fluorine-based water repellent (AsahiGuard AG-E081 manufactured by ASAHI GLASS CO., Ltd.) was applied according to the padding method. Then, after drying and heat setting, a fluorescent orange-red colored high-visibility fabric was obtained.

Comparative Example 1

In Comparative example 1, a fabric was obtained using the same materials and methods as in Example 1, except that the fluorescent-pigment-containing liquid resin was not applied to the fabric.

Comparative Example 2

In Comparative example 2, a fabric was obtained using the same materials and methods as in Example 1, except that the fabric was not dyed with dyes.

Example 2

A nylon taffeta fabric (Nylon 6 with 77 dtex/68 filaments was used for both warp and weft. The warp density was 123 yarns per 2.54 cm while the weft density was 90 yarns per 2.54 cm) was dyed at 105° C. for 30 minutes. The dyes were Twintex Brill. Flavin GN200 (a disperse dye manufactured by Futabasangyo Co., Ltd.) and Kayalon Polyester Brill. Red FB-S (a disperse dye manufactured by Nippon Kayaku Co., Ltd.). Then, after the fabric was rinsed in water and dried at 120° C. for 30 seconds, an orange-colored fabric was obtained.

Next, the following fluorescent-pigment-containing liquid resin was applied to one entire surface of the orange-colored fabric using a rotary screen printing machine. After being dried at 90° C. for one minute, this fabric underwent heat treatment at 160° C. for 30 seconds.

Next, 5% solution of a fluorine-based water repellent (AsahiGuard AG-E081 manufactured by ASAHI GLASS CO., Ltd.) was applied according to the padding method. After drying, heat treatment, and water repellent finishing were performed, calendaring was performed at 170° C. under pressure (linear pressure) of 128 kg/cm to obtain the fabric applied with the fluorescent-pigment-containing resin.

[Fluorescent-Pigment-Containing Liquid Resin]

| | |
|---|---|
| DK binder FV-10C (emulsion liquid containing phosphate ester amide, urethane resin, mineral spirits, and water, and manufactured by DAIKYO CHEMICAL CO., LTD.) | 75% by mass |

-continued

| | |
|---|---|
| RYUDYE-W Lumius Orange NF (fluorescent pigment manufactured by DIC Corporation) | 20% by mass |
| RYUDYE-W Orange RS-E (pigment manufactured by DIC Corporation) | 1% by mass |
| RYUDYE-W Yellow NLA275 (pigment manufactured by DIC Corporation) | 2% by mass |
| Crosslinker (isocyanate-based crosslinker with a solid content of 100%) | 2% by mass |

Next, the pipe coater was used for applying a 0.15-mm-thick coating of the following resin solution to the aforementioned fabric's surface where the fluorescent-pigment-containing resin was not applied. Then, this fabric was immersed in water, which solidifies the urethane resin. After being subjected to solvent removal in water at temperatures of 40° C. and 20° C., the fabric was dried at 120° C. for 3 minutes and underwent heat setting at 150° C. for one minute. As a result, a microporous waterproof film was formed on the fabric surface where the fluorescent-pigment-containing resin was not applied.

[Liquid Resin]

| | |
|---|---|
| Ester-based polyurethane resin (with a solid content of 25%) | 100 parts by mass |
| N,N-dimethylformamide (DMF) | 20 parts by mass |
| Calcium carbonate dispersant (with a solid content of 60%) | 20 parts by mass |
| Isocyanate-based crosslinker | 2 parts by mass |

After this, final setting was performed at 170° C. As a result, a fluorescent orange-red high-visibility fabric was obtained.

Comparative Example 3

In Comparative example 3, a fabric was obtained using the same materials and methods as in Example 2, except that the fluorescent-pigment-containing liquid resin was not applied to the fabric.

Comparative Example 4

In Comparative example 4, a fabric was obtained using the same materials and methods as in Example 2, except that the fabric was not dyed with dyes.

Example 3

A plain weave fabric made of 60 mass percent of modacrylic fibers and 40 mass percent of cotton was dyed at 100° C. for 30 minutes. The dyes were Kayacryl Brill. Yellow Flavine 10G-ED (a cationic dye manufactured by Nippon Kayaku Co., Ltd.), Aizen Cathilon Pink BL-DP80 (a cationic dye manufactured by HODOGAYA CHEMICAL CO., LTD.), MIKA white ATN (a fluorescent whitening agent manufactured by Nippon Kayaku Co., Ltd.), and Hakkol BRK (a fluorescent whitening agent manufactured by SHOWA KAGAKU KOGYO CO., LTD.). Then, after rinsed in hot water and cold water, the fabric was dried at 120° C. for 30 seconds and underwent heat setting at 140° C. for one minute. As a result, an orange-colored fabric was obtained.

Next, the following fluorescent-pigment-containing liquid resin was applied to one entire surface of the orange-colored fabric using a rotary screen printing machine. After being dried at 90° C. for one minute, this fabric underwent heat treatment at 160° C. for 30 seconds.

[Fluorescent-Pigment-Containing Liquid Resin]

| | |
|---|---|
| DK binder FV-10C (emulsion liquid containing phosphate ester amide, urethane resin, mineral spirits, and water, and manufactured by DAIKYO CHEMICAL CO., LTD.) | 75% by mass |
| RYUDYE-W Lumius Orange NF (fluorescent pigment manufactured by DIC Corporation) | 20% by mass |
| RYUDYE-W Orange RS-E (pigment manufactured by DIC Corporation) | 1% by mass |
| RYUDYE-W Yellow NLA275 (pigment manufactured by DIC Corporation) | 2% by mass |
| Crosslinker (isocyanate-based crosslinker with a solid content of 100%) | 2% by mass |

Next, a urethane resin solution having the following composition was prepared to form a waterproof film on the aforementioned fabric's surface where the fluorescent-pigment-containing resin was not applied.

[Urethane Resin Solution]

| | |
|---|---|
| Ether-based urethane resin (with a solid content of 30%) | 100 parts by mass |
| Flame retardant (diethylphosphinic acid aluminum salt) | 30 parts by mass |
| Methyl ethyl ketone (MEK) | 70 parts by mass |
| White pigment | 8 parts by mass |

A 0.1-mm-thick coating of this urethane resin solution is applied to a piece of release paper, which is then dried at 120° C. In this way, a non-porous urethane film (the degree of water swelling [mass swelling] of the waterproof film was 85%) was obtained. Next, a 0.1-mm-thick coating of an adhesive solution having the following composition, where the degree of water swelling (mass swelling) of a cured film was 30%, was applied to this urethane resin film and dried at 120° C. After this, the adhesive-applied surface of this resin-formed release paper was laminated on and adhered to the orange-colored fabric's surface where the fluorescent-pigment-containing resin was not applied. After aging at 80° C. for 72 hours, the release paper was peeled off and removed.

[Adhesive Solution (Urethane Resin Solution Used as Adhesive)]

| | |
|---|---|
| Ether-based urethane resin (with a solid content of 50%) | 100 parts by mass |
| Flame retardant (diethylphosphinic acid aluminum salt) | 50 parts by mass |
| Toluene | 30 parts by mass |
| Methyl ethyl ketone | 10 parts by mass |
| Takenate WD-725 (isocyanate-based crosslinker manufactured by Takeda Pharmaceutical Company Limited) | 9 parts by mass |
| Curing catalyst HI215 (manufactured by Dainichiseika Color & Chemicals Mfg. Co., Ltd.) | 0.5 parts by mass |

Next, 5% solution of AsahiGuard AG-E081 (a fluorine-based water repellent manufactured by ASAHI GLASS CO., Ltd.) was applied according to the padding method. After drying, heat treatment, and water repellent finishing were performed, final setting was performed at 140° C. As a result, a fluorescent orange-red high-visibility fabric was obtained.

Comparative Example 5

In Comparative example 5, a fabric was obtained using the same materials and methods as in Example 3, except that the fluorescent-pigment-containing liquid resin was not applied to the fabric.

Comparative Example 6

In Comparative example 6, a fabric was obtained using the same materials and methods as in Example 3, except that the fabric was not dyed with dyes.

FIG. 1 is a diagram showing the results of measurements and evaluations of various physical properties for each of the high-visibility fabrics obtained in Examples 1 to 3 and each of the fabrics obtained in Comparative examples 1 to 6. As the luminance factor of the colored fabric before the application of the fluorescent-pigment-containing resin in each Example, the measurement value in corresponding Comparative example in which the fluorescent-pigment-containing resin was not applied is used.

As shown in an evaluation item A in FIG. 1, all the high-visibility fabrics manufactured from various fabrics in Examples 1, 2, and 3 met the requirements for orange-red in "5.1 Colour performance requirements of new material" of ISO 20471:2013, and thus were superior in visibility. FIG. 2 shows the requirements for orange-red in "5.1 Colour performance requirements of new material" of ISO 20471:2013.

Moreover, as shown in an evaluation item B, all the high-visibility fabrics manufactured from the various fabrics in Examples 1, 2, and 3 met the requirements of "5.2 Colour after Xenon test" of ISO 20471:2013. It can be understood that these fabrics were superior in visibility even when exposed to sunlight and were also superior in lightfastness.

Particularly when the para-aramid filament fibers were used for the fabric, the requirements of "5.1 Colour performance requirements of new material" of ISO 20471:2013 could not be met in Comparative example 1. However, in Example 1, the requirements of "5.1 Colour performance requirements of new material" could be met both before and after the xenon lightfastness testing.

Similarly, when the composite fabric made of modacrylic fibers and cotton were used for the fabric, the requirements of "5.1 Colour performance requirements of new material" of ISO 20471:2013 could not be met before the xenon lightfastness testing in Comparative example 5. However, in Example 3, the requirements of "5.1 Colour performance requirements of new material" could be met both before and after the xenon lightfastness testing.

Furthermore, as shown in an evaluation item C, the high-visibility fabrics in Examples 1, 2, and 3 maintained superior air permeability even after the fluorescent-pigment-containing resin was applied to the entire surface of the fabric. A possible reason for this is that the fluorescent-pigment-containing resin film formed on the fabric was so thin that spaces were left between the yarns and between the fibers, as in evaluation items F and G described later.

In Examples 1, 2, and 3, work clothes were made using the orange-colored high-visibility fabrics obtained before the lamination of the PTFE film, the porous waterproof film made of urethane resin, and the non-porous polyurethane resin film. As a result, such work clothes were superior in visibility, and the air permeability allowed these work clothes to be comfortable to wear with less stuffiness.

Moreover, as shown in an evaluation item D, the high-visibility fabrics in Examples 1, 2, and 3 maintained superior moisture permeability even after the waterproof films were laminated thereon. Furthermore, as shown in evaluation item E, these fabrics were superior in waterproof property.

Moreover, as shown in the evaluation item F for surface observation of the colored part of the high-visibility fabric for each of Examples 1, 2, and 3, the fluorescent-pigment-containing resin was attached to the entire surface (fiber surface) of the part applied with the resin on the fabric as shown in FIG. 3. FIG. 3 is a diagram showing electron microscope photographs of the surface (at magnifications of 30, 50, 100, 1500, and 2000 times) of the high-visibility fabric in Example 3. Similar surfaces were observed in Examples 1 and 2 as well.

Furthermore, as shown in FIG. 4, although the resin was attached to some crossing points of the yarns and also covered some spaces between the fibers, most parts were not covered with the resin and spaces were left between the yarns and between the fibers. FIG. 4 is a diagram showing electron microscope photographs of the surfaces (the warp surface at 150 times magnification, the weft surface at 250 times magnification, and the crossing point at 1500 times magnification) of the high-visibility fabric in Example 3. Similar surfaces were observed in Examples 1 and 2 as well.

Moreover, as shown in the evaluation item G for height measurement of the part applied with the fluorescent-pigment-containing resin on the high-visibility fabric for each of Examples 1, 2, and 3, the height of an area containing particles (assumed to be pigments) with diameters of 1 μm to 2 μm was 1 μm to 2 μm because of these particles. The height of an area where the resin was attached but no particles were seen was less than 1 μm even observed at 4500 times magnification. Thus, it can be understood that an extremely thin resin film was formed. FIG. 5 is a diagram showing electron microscope photographs of cross sections (at magnifications of 300, 500, 3000, and 4500 times) of the high-visibility fabric in Example 3. Similar cross sections were observed in Examples 1 and 2 as well.

Furthermore, as shown in an evaluation item H, the high-visibility fabrics in Examples 1, 2, and 3 were still soft in texture even though slightly more hardened than before the processing.

Moreover, as shown in an evaluation item I, the high-visibility fabrics in Examples 1 and 3 were flame retardant.

INDUSTRIAL APPLICABILITY

The high-visibility fabric according to the present invention is widely usable for fiber products, such as clothing, made using fabrics.

The invention claimed is:

1. A high-visibility fabric comprising:
a pre-colored fabric; and
a fluorescent-pigment-containing resin on at least one surface of the pre-colored fabric, wherein
the fluorescent-pigment-containing resin has a height of less than 20 μm,
a part of the high-visibility fabric including the fluorescent-pigment-containing resin meets requirements 5.1 and 5.2 of ISO 20471:2013, and
a luminance factor of the pre-colored fabric before an application of the fluorescent-pigment-containing resin is higher than a luminance factor of the part of the high-visibility fabric including the fluorescent pigment-containing resin.

2. The high-visibility fabric according to claim 1, wherein the height is less than or equal to 10 μm.

3. The high-visibility fabric according to claim 1, wherein the pre-colored fabric has a waterproof resin film on one surface.

4. The high-visibility fabric according to claim 1, wherein the fluorescent-pigment-containing resin contains flame retardant chemicals.

5. High-visibility clothing that is at least partially made using the high-visibility fabric according to claim 1.

6. The high-visibility fabric according to claim 1, wherein the height is less than or equal to 2 μm.

7. The high-visibility fabric according to claim 1, wherein the high-visibility fabric is flame retardant.

8. The high-visibility fabric according to claim 1, wherein the fluorescent-pigment-containing resin contains pigment having no fluorescence.

9. The high-visibility fabric according to claim 1, wherein the pre-colored fabric includes at least one material selected from the group consisting of: polyester, nylon, aramid, acrylic, modacrylic, polyurethane, acetate, rayon, polylactate, polyimide, polyphenylene sulfide, fluorine, cotton, linen, silk, and wool.

10. The high-visibility fabric according to claim 1, wherein the pre-colored fabric is colored before an application of the fluorescent-pigment-containing resin using a dye having fluorescence.

11. The high-visibility fabric according to claim 1, wherein a luminance factor of the pre-colored fabric before an application of the fluorescent-pigment-containing resin meets requirement 5.1 of ISO 20471:2013.

12. A high-visibility fabric comprising:
a pre-colored fabric; and
a fluorescent-pigment-containing resin on at least one surface of the pre-colored fabric, wherein
the fluorescent-pigment-containing resin has a height of less than 20 μm,
a part of the high-visibility fabric including the fluorescent-pigment-containing resin meets requirements 5.1 and 5.2 of ISO 20471:2013, and
a luminance factor of the pre-colored fabric before an application of the fluorescent-pigment-containing resin exceeds a lower limit of a luminance factor as specified in require 5.1 ISO 20471:2013 by 0.05 or more.

13. The high-visibility fabric according to claim 1, wherein chromaticity coordinates of the pre-colored fabric before an application of the fluorescent-pigment-containing resin do not meet requirement 5.1 of ISO 20471:2013.

14. The high-visibility fabric according to claim 1, wherein the pre-colored fabric including the fluorescent-pigment-containing resin has air permeability.

15. The high-visibility fabric according to claim 1, wherein a composite color of the pre-colored fabric and the fluorescent-pigment-containing resin meets requirements 5.1 and 5.2 of ISO 20471:2013.

16. A method of manufacturing a high-visibility fabric which includes a pre-colored fabric and a fluorescent-pigment-containing resin on at least one surface of the pre-colored fabric, the method comprising:
applying the fluorescent-pigment-containing resin to the at least one surface of the pre-colored fabric, a part of the high-visibility fabric including the fluorescent-pigment-containing resin meeting requirements 5.1 and 5.2 of ISO 20471:2013, and the fluorescent-pigment-containing resin having a height of less than 20 μm,
wherein a luminance factor of the pre-colored fabric before the application of the fluorescent-pigment-containing resin is higher than a luminance factor of the part of the high-visibility fabric including the fluorescent-pigment-containing resin.

17. A method of manufacturing a high-visibility fabric which includes a pre-colored fabric and a fluorescent-pigment-containing resin on at least one surface of the pre-colored fabric, the method comprising:

applying the fluorescent-pigment-containing resin to the at least one surface of the pre-colored fabric, a part of the high-visibility fabric including the fluorescent-pigment-containing resin meeting requirements 5.1 and 5.2 of ISO 20471:2013, and the fluorescent-pigment-containing resin having a height of less than 20 μm, wherein a luminance factor of the pre-colored fabric before the application of the fluorescent-pigment-containing resin exceeds a lower limit of a luminance factor as specified in requirement 5.1 of ISO 20471:2013 by 0.05 or more.

* * * * *